United States Patent [19]

Anstötz et al.

[11] Patent Number: 4,960,046

[45] Date of Patent: Oct. 2, 1990

[54] CALENDER ARRANGEMENT

[75] Inventors: Helmut Anstötz, Tönisvorst; Egon Brink, Kempen, both of Fed. Rep. of Germany

[73] Assignee: Eduard Küsters Maschinenfabrik GmbH & Co KG, Krefeld, Fed. Rep. of Germany

[21] Appl. No.: 370,243

[22] Filed: Jun. 22, 1989

[30] Foreign Application Priority Data

Jun. 22, 1988 [DE] Fed. Rep. of Germany ..... 3821027

[51] Int. Cl.[5] ..... B30B 3/04; B30B 15/34

[52] U.S. Cl. ..... 100/93 RP; 100/162 R; 100/162 B

[58] Field of Search ..... 100/93 RP, 160, 161, 100/162 R, 162 B, 163 R, 163 A

[56] References Cited

U.S. PATENT DOCUMENTS

| | | | |
|---|---|---|---|
| 3,451,331 | 6/1969 | Fredrickson et al. | 100/162 R X |
| 3,802,044 | 4/1974 | Spillmann et al. . | |
| 3,885,283 | 5/1975 | Biondetti . | |
| 4,128,053 | 12/1978 | Kankaanpää100 | 160 X/ |
| 4,307,501 | 12/1981 | Ahrweiler . | |
| 4,326,456 | 4/1982 | Kankaanpää100 | 162 R X/ |
| 4,332,191 | 6/1982 | Kankaanpää100 | 162 R/ |
| 4,366,752 | 1/1983 | Koski . | |
| 4,375,188 | 3/1983 | Leiviskä100 | 162 R/ |
| 4,497,246 | 2/1985 | Pav et al. | 100/162 R |
| 4,534,829 | 8/1985 | Ahrweiler et al. . | |
| 4,656,709 | 4/1987 | Mingers et al. . | |

FOREIGN PATENT DOCUMENTS

| | | |
|---|---|---|
| 1411327 | 3/1973 | Fed. Rep. of Germany . |
| 3640903 | 6/1988 | Fed. Rep. of Germany . |

*Primary Examiner*—Edward L. Roberts
*Assistant Examiner*—Stephen F. Gerrity
*Attorney, Agent, or Firm*—Kenyon & Kenyon

[57] ABSTRACT

A calender arrangement including a first stack of rolls with a first heated hard roll, which, together with a center soft roll, forms a nip. On the other side of the soft roll, another soft roll is arranged, which, together with the soft roll, forms another nip. A second stack of rolls with a soft roll which interacts with a second hard heated roll follows the first stack of rolls. The second hard heated roll contacts the paper web on the side lying opposite the side contacted by the first heated hard roll in the first stack. A further hard roll can also cooperate with the hard roll in the second stack to form a hard nip. The treatment that the paper web undergoes, varies in accordance with the type and sequence of the nips through which it is guided.

12 Claims, 1 Drawing Sheet

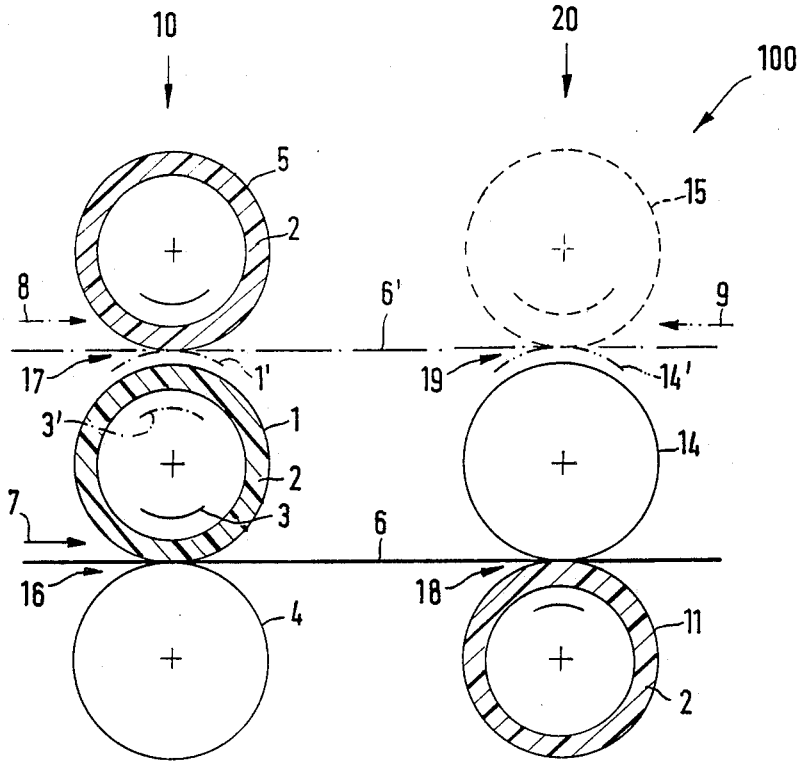
10
20
100
5
2
15
8
6'
9
17
1'
19
14'
3'
1
14
2
7
3
6
16
18
4
11
2

CALENDER ARRANGEMENT

BACKGROUND OF THE INVENTION

This invention relates to a calender arrangement with a plurality of hard and soft rolls, supported to be positioned against each other and separated from each other while forming different nips, through which a paper web can be guided on a number of different paths, in general and more particularly such a calender arrangement which is of low cost but still permits various paper web treatments to be carried out.

A calender arrangement of this general type is described in German Published Pat. Application No. 31 19 677 (U.S. Pat. No. 4,366,752). The arrangement of the embodiment illustrated therein comprises six hard rolls, arranged one over another, around which a paper web is guided in a meandering path. Soft rolls are supported so that they can be positioned from the side against one part of the hard rolls of this stack of rolls. If the hard rolls are separated from each other and the soft rolls are brought into engagement, then the web experiences a calendering only in those soft nips where a hard roll interacts with a soft roll. Alternatively, the two topmost hard rolls can be driven together, so that the paper web feeding between them initially experiences a smoothing out in a hard nip and subsequently experiences satinage in the soft nips. Finally, it is also possible to separate the soft rolls from the hard rolls and to place the hard rolls against each other, at least partly, so that a pure smoothing effect results on the paper web. The number of hard roll nips varies in accordance with the number of hard rolls placed against each other. Based on different needs, the paper web can be accordingly passed through the known calender arrangement in different ways.

The design of the embodiment described is quite costly, especially due to the necessity of positioning in different directions.

In view of this, there is a need to create a calender arrangement, entailing the lowest possible cost, which will still enable various paper web treatments to be performed without re-equipping the calender.

SUMMARY OF THE INVENTION

In the general type of calender roll arrangement described above, this need is fulfilled by providing a calender arrangement which includes two successive stacks of rolls disposed one after the other in the direction of travel of the paper web and in which one of the stacks of rolls has a soft center roll with bending control, whose effective direction can be changed by 180°, a soft roll interacting with said soft center roll when the one effective direction is selected, and a heated hard roll arranged on the opposite side such as to interact with the soft center roll and to contact one side of the paper web when the other effective direction is selected, and the other stack of rolls has at least one pair of rolls including a soft roll with bending control and a heated roll which engages the other side of the paper web.

When the soft center roll of the one stack of rolls interacts with the soft roll, the result is that the paper web is treated the same on both sides in a more or less doubly soft nip. The thus treated mat paper web is generally guided past the second stack of rolls, so that it retains its mat surface.

If the effective direction of the soft center roll is now reversed and directed against the heated hard roll and, at this point, the paper web is guided through this nip, it then under goes a one sided gloss treatment and is then guided through the nip of the second stack of rolls, to undergo a gloss treatment on the other side. In this way, a paper web which is glossy on both sides is obtained.

The preferred application of the calender arrangement according to the present invention is in line. This means that the calender arrangement is used during the course of the running paper web as it comes out of the paper machine, and is operated at the same production speed as the paper web. An important application is using the calender arrangement in interaction with a coating unit.

The plastic coatings applied at speeds of up to 1000 m/min, which occur during in line operation, must withstand arduous demands, if they are not to be destroyed in the short term, as a result of fulling heating effects which are too high. To deal with this problem, the soft rolls preferably include a plastic coating with a Shore D hardness of 80° to 90°. This high degree of hardness of the coatings of the "soft" rolls is an important characteristic in this respect. Thus, the designation "soft" is to be understood in the sense of calender terminology. In other words, the roll is not actually a soft roll, but rather a roll with a plastic or paper coating. Thus, in this context, "soft" basically means only the opposite of a steel roll. A hard roll experiences less of a fulling heating effect.

It should be noted that a calender arrangement with such "soft" rolls in two successive stacks of rolls for every two rolls is known by itself from the German Pat. No. 32 01 635 (U.S. Pat. No. 4,534,829). However, the specific embodiment disclosed therein does not concern different treatments of a paper web guided through the calender arrangement in various ways.

Rollers with a nonrotatable crosshead and a hollow cylinder revolving around this crosshead are what are referred to herein as having bending control. In such rolls, the force is transmitted by a hydraulic device from the crosshead against the inner circumference of the hollow cylinder. This can be accomplished by hydraulic pistons arranged in rows on the crosshead, along the roll, as disclosed in the German Printed Pat. No. 22 30 139 (U.S. Pat. No. 3,802,044) and German Pat. No. 30 03 395 (U.S. Pat. No. 4,307,501). It can be accomplished as well by hydraulic fluid contained in a longitudinal chamber, which is open towards the inner circumference of the hollow cylinder and which extends over the length of the hollow cylinder, as disclosed in the German Pat. No. 14 11 327.

The effective direction of such rolls can be reversed very simply by turning the crosshead by 180°. However, because it is necessary to corotate the connection lines, this method has a disadvantage. There are, however, rolls with bending control which have several force exerting devices working in different directions, such as those shown, for example, in German Printed Pat. No. 22 30 139, for the swimming roll disclosed in German Pat. No. 34 45 890 (U.S. Pat. No. 4,656,709) and also in German Published Pat. Application No. 36 40 903. These rolls can be operated upwards and downwards, without having to change the position of the crosshead in any way. All of these types of rolls can be considered for application in the case of the present invention.

In every nip, at least one roll should have bending control. In particular, it is advantageous if the bending of both rolls can be controlled in the nip where both soft rolls interact.

A way to expand the number of treatment variations is to assign an additional hard roll, preferably one with bending control, to the second stack of rolls. Thereby, this additional hard roll can interact with the hard heated roll, in order to form a hard nip, through which the paper web can be guided to produce a smoothing effect. This can then be the only treatment of the paper web. In such a case, the paper web runs through the calender arrangement without another nip being active.

When the paper web first runs through the stack of rolls with the soft center roll, the nip between the two soft rolls of the first stack of rolls is opened during the smoothing process.

However, it is also possible, to allow the paper web to run through the calender arrangement the other way round, so that it first passes the hard nip of the second stack of rolls and then, in a smoothed state, enters into the nip between the two soft rolls of the other stack of rolls. In the case of gloss treatment in the other nips, the feed direction is unimportant.

Although it is not a requirement, it is recommended that the stack of rolls be arranged in vertical planes, so that the paper web can pass through horizontally, for the most part. This makes it possible to guide the paper web at a constant level and to simplify the handling of the paper web when it is s drawn in.

In the illustrated embodiment of the present invention, the heated hard roll of the first stack of rolls is the bottom roll. The arrangement of the other rolls follows from this.

BRIEF DESCRIPTION OF THE DRAWING

The single FIGURE is a schematic lateral view of the calender arrangement according to the present invention showing only the contours of the rolls.

DETAILED DESCRIPTION

The calender arrangement 100 of the present invention comprises a "first" stack of rolls 10 and a "second" stack of rolls 20. The stack of rolls 10 comprises a soft center roll 1 With a plastic coating, which has a Shore D hardness of 80° to 90°, e.g., about 85°. The roll 1 is internally supported by hydraulic means, as depicted by the circular arc section 3. In the case of the operating mode shown with a solid line, the soft roll 1 interacts with a heated hard roll 4, which is arranged below it. An additional soft roll 5 with bending control, which has a plastic coating 2 with a Shore D hardness of 80° to 90°, e.g., about 85°, is provided above the roll 1.

It is important that the effective direction of the roll 1 be able to be changed by 180°. In the operating state represented in solid lines, the roll 1 acts in a downward direction on the heated roll 4. After changing the effective direction by 180°, as indicated by the circular arc section 3', shown with a dot-dash line, the roll 1 acts in an upwards direction cooperating with the roll 5. Thereby, the roll 1 shifts slightly upwards into the position represented by the dot-dash line 1'. This is caused either by the corresponding shifting of its roll ends or by an "inner stroke", in accordance with the German Printed Pat. No. 22 54392 (U.S. Pat. No. 3,885,283).

The stack of rolls 20 comprises a pair of rolls including a soft roll 11 with bending control and a heated hard roll 14, which are arranged in the reverse order of rolls 1 and 4. This means, while the heated roll 4 contacts the bottom side of the paper web 6, the heated hard roll 14 does this from the top side of the paper web 6. The roll 11 has a plastic coating 2 with a Shore D hardness of 80° to 90°, e.g., about 85°, in the same way as roll 1.

Above the heated hard roll 14, an additional hard roll 15 can be provided. Preferably its bending can be controlled. Roll 15 is arranged so that it can be placed against the heated hard roll 14, as indicated by the doubled dotdash line 14'.

The rolls 4, 1 and 5 or 11,14 and 15 are arranged with their axes in vertical planes, which are spaced from each other in the direction of travel of the paper web.

Thus, in the stack of rolls 10, either a soft nip 16 with a soft roll 1 and a hard roll 4, or a "doubly soft" nip 17 with two soft rolls 1 and 5 is possible. In the stack of rolls 20, either a soft nip 18 arranged in reverse or a hard nip 19 is possible.

When the paper web 6, as depicted with a solid line in the drawing, is guided through both lower nips 16 and 18 in the direction indicated by the arrow 7, it undergoes a gloss treatment on both sides.

When the paper web, as indicated by 6', is guided instead through the upper nip 17 of the stack of rolls 10, in the direction of the arrow 8, it undergoes a double sided mat treatment between the soft rolls 1 and 5.

If the paper web in position 6' is guided through the nip 19 in the direction of the arrow 8 while nip 17 is open, it undergoes a smoothing treatment. In this connection, the nip 17 will always be open, because it generally is out of the question to have a smoothing treatment downstream from a mat treatment. Use of both nips can be practical, however, if the paper web in position 6' is guided through the calender arrangement 100 in the direction of arrow 9, from the right to the left. Then the paper web will undergo a smoothing treatment in nip 19 and, subsequently, a mat treatment will be performed in nip 17.

For these different treatments, all that is required is that the roll 1 or 14 be able to shift out of the position represented With solid lines into the positions represented by the dot-dash line 1' or the double dot-dash line 14', and that the effective direction of the internal hydraulic support system be able to be changed by 180° from 3 to 3'.

On the one hand, the roll nips 17 and 19 and, on the other hand, 16 and 18 lie at the same level, so that the paper webs 6 and 6' can be guided horizontally through the stack of rolls, even if on different planes.

What is claimed is:

1. A calender arrangement having a plurality of hard and soft rolls, supported to be positioned against each other and separated from each other while forming different nips, through which a paper web can be guided on a number of different paths, comprising:

first and second successive stacks of rolls following each other in the direction of travel of the paper web;

said first stack of rolls including a soft center roll with bending control, the effective direction of which can be changed by 180°, a soft roll supported on one side of said soft center roll for interaction with said soft center roll, when one effective direction is selected and a first heated hard roll arranged on the opposite side of said soft center roll and supported for interaction with said soft center roll when its effective direction is changed by 180°, said heated hard roll thereby contacting one side of the paper web; and said second stack of rolls including at least one pair of rolls comprising a soft roll with bending control and second heated hard roll disposed such as to engage on the other side of the paper web.

2. The calender arrangement of claim 1, wherein said soft rolls have a plastic coating with a Shore D hardness of 80° to 90°.

3. The calender arrangement of claim 2 and further including a hard roll with bending control in said second stack of rolls on the side of said second heated hard roll lying opposite said soft roll, to form a hard nip.

4. The calender arrangement of claim 3, wherein the rolls of said first and second stacks of rolls are arranged in vertical planes, and the roll nips between both upper rolls of both stacks of rolls, as well as the roll nips between both lower rolls lie at the same level.

5. The calender arrangement of claim 4, wherein the heated hard roll of the first stack of rolls is the lowest roll of said first stack of rolls.

6. The calender arrangement of claim 2, wherein the rolls of said first and second stacks of rolls are arranged in vertical planes, and the roll nip between the lower two rolls of said first stack of rolls lies at the same level as the roll nip between the rolls of said second stack.

7. The calender arrangement of claim 6, wherein the heated hard roll of the first stack of rolls is the lowest roll of said first stack of rolls.

8. The calender arrangement of claim 1 and further including a hard roll with bending control in said second stack of rolls on the side of said second heated hard roll lying opposite said soft roll, to form a hard nip.

9. The calender arrangement of claim 8, wherein the rolls of said first and second stacks of rolls are arranged in vertical planes, and the roll nips between both upper rolls of both stacks of rolls, as well as the roll nips between both lower rolls lie at the same level.

10. The calender arrangement of claim 9, wherein the heated hard roll of the first stack of rolls is the lowest roll of said first stack of rolls.

11. The calender arrangement of claim 1, wherein the rolls of said first and second stacks of rolls are arranged in vertical planes, and the roll nip between the lower two rolls of said first stack of rolls lies at the same level as the roll nip between the rolls of said second stack.

12. The calender arrangement of claim 11, wherein the heated hard roll of the first stack of rolls is the lowest roll of said first stack of rolls.

* * * * *